US010081770B2

(12) United States Patent
Koseoglu et al.

(10) Patent No.: US 10,081,770 B2
(45) **Date of Patent: *Sep. 25, 2018**

(54) PROCESS FOR OXIDATIVE DESULFURIZATION AND SULFONE DISPOSAL USING SOLVENT DEASPHALTING

(71) Applicant: Saudi Arabian Oil Company, Dhahran (SA)

(72) Inventors: Omer Refa Koseoglu, Dhahran (SA); Abdennour Bourane, Ras Tanura (SA); Stephane Kressmann, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/465,179

(22) Filed: Mar. 21, 2017

(65) Prior Publication Data

US 2017/0190990 A1 Jul. 6, 2017

Related U.S. Application Data

(63) Continuation-in-part of application No. 12/876,636, filed on Sep. 7, 2010, now Pat. No. 9,598,647.

(51) Int. Cl.
*C10G 53/14* (2006.01)

(52) U.S. Cl.
CPC ..... *C10G 53/14* (2013.01); *C10G 2300/202* (2013.01); *C10G 2300/44* (2013.01)

(58) Field of Classification Search
CPC ..... C10G 21/003; C10G 21/06; C10G 21/12; C10G 21/16; C10G 21/22; C10G 21/28;
(Continued)

(56) References Cited

U.S. PATENT DOCUMENTS 2,704,295 A 3/1955 Gilbert et al.
2,993,841 A 7/1961 Sarno
(Continued)

FOREIGN PATENT DOCUMENTS

WO 0218518 A1 3/2002
WO 03014266 A1 2/2003
(Continued)

OTHER PUBLICATIONS

Gillis, et al. What's New in Solvent Deasphalting?, 1998, Heavy Oils Conference, pp. 1-13.*
(Continued)

*Primary Examiner* — Renee E Robinson
*Assistant Examiner* — Derek N Mueller
(74) *Attorney, Agent, or Firm* — Bracewell LLP; Constance Gall Rhebergen

(57) ABSTRACT

Embodiments provide a method and apparatus for upgrading a hydrocarbon feedstock. According to at least one embodiment, the method includes the steps of (a) supplying a hydrocarbon feedstock to an oxidation reactor, wherein the hydrocarbon feedstock is oxidized in the presence of a catalyst under conditions sufficient to selectively oxidize sulfur and nitrogen compounds present in the hydrocarbon feedstock; (b) separating the hydrocarbons and the oxidized sulfur and nitrogen compounds by solvent extraction; (c) collecting a first residue stream that includes the oxidized sulfur and oxidized nitrogen compounds; (d) supplying the first residue stream to a deasphalting unit; (e) supplying the hydrocarbons to an adsorption column to produce a high purity hydrocarbon product and a second residue stream; and (f) supplying spent adsorbent to the deasphalting unit to remove additional contaminants from the high purity hydrocarbon product in the deasphalting unit.

17 Claims, 3 Drawing Sheets

(58) Field of Classification Search
CPC ..... C10G 2300/202; C10G 2300/206; C10G 2300/44; C10G 25/003; C10G 27/04; C10G 27/12; C10G 53/04; C10G 53/08
See application file for complete search history.

(56) References Cited

U.S. PATENT DOCUMENTS

| | | | | |
|---|---|---|---|---|
| 3,551,328 | A | 12/1970 | Cole et al. | |
| 3,816,301 | A | 6/1974 | Sorgenti | |
| 5,958,224 | A | 9/1999 | Ho et al. | |
| 5,961,820 | A | 10/1999 | Jeanblanc et al. | |
| 6,087,544 | A | 7/2000 | Wittenbrink et al. | |
| 6,160,193 | A * | 12/2000 | Gore | C10G 27/04 208/208 R |
| 6,174,178 | B1 | 1/2001 | Reinhold | |
| 6,277,271 | B1 | 8/2001 | Kocal | |
| 6,402,940 | B1 | 6/2002 | Rappas | |
| 6,596,914 | B2 | 7/2003 | Gore et al. | |
| 6,673,236 | B2 | 1/2004 | Stanciulescu et al. | |
| 7,179,368 | B2 | 2/2007 | Rabion et al. | |
| 7,252,756 | B2 | 8/2007 | Gong et al. | |
| 7,374,666 | B2 | 5/2008 | Wachs | |
| 7,491,316 | B2 | 2/2009 | Ketley et al. | |
| 9,598,647 | B2 * | 3/2017 | Bourane | C10G 21/003 |
| 2005/0150819 | A1 | 7/2005 | Wachs | |
| 2005/0189261 | A1 * | 9/2005 | Briot | C10G 53/14 208/243 |
| 2006/0180501 | A1 | 8/2006 | Da Silva et al. | |
| 2006/0226049 | A1 | 10/2006 | Nemeth et al. | |
| 2007/0051667 | A1 * | 3/2007 | Martinie | C10G 27/00 208/208 R |
| 2007/0102323 | A1 | 5/2007 | Lee et al. | |
| 2008/0093260 | A1 | 4/2008 | Koseoglu | |
| 2012/0055843 | A1 | 3/2012 | Bourane | |
| 2017/0029720 | A1 | 2/2017 | Koseoglu | |

FOREIGN PATENT DOCUMENTS

| | | | |
|---|---|---|---|
| WO | 2006071793 | A1 | 7/2006 |
| WO | 2007106943 | A1 | 9/2007 |

OTHER PUBLICATIONS

Alberto de Angelis et al.: "Heteropolyacids as effective catalysts to obtain zero sulfur diesel", Pure Appl. Chem., vol. 79, No. 11, Dec. 31, 2007, pp. 1887-1894.
Atsushi Ishihara et al.: "Oxidative desulfurization and denitrogenation of a light gas oil using an oxidation/adsorption continuous flow process", Applied Catalysis A: General, Dec. 31, 2005. pp. 279-287.
Ebbe R. Skov et al.: "The ULSD oxidative desulfurisation option", Hydrocarbon Engineering (Reprinted from May 2007) May 31, 2007, pp. 1-5.
F. Zannikos et al.: "Desulfurization of petroleum fractions by oxidation and solvent extraction", Fuel Processing Technology, vol. 42, Dec. 31, 1995, pp. 35-45.
Sulphco: "Oxidative Desulfurization", IAEE Houston Chapter, Jun. 11, 2009, pp. 1-8.
Farhan Al-Shahrani et al.: "Desulfurization of diesel via the H202 oxidation of aromatic sulfides to sulfones using a tungstate catalyst", Applied Catalysis B: Environmental, vol. 73, Jan. 7, 2007, pp. 311-316.
Ron Gatan et al.: "Oxidative Desulfurization: A New Technology for ULSD", Prepr. Pap.—Am. Chem. Soc. Div. Fuel Chem. vol. 49, No. 2, Dec. 31, 2004, pp. 577-579.
PCT Written Opinion of the International Preliminary Examining Authority dated Feb. 1, 2013; International Application No: PCT//US2011/050590; International File Date: Sep. 7, 2011.
Gillis et al., "Whats New in Solvent Deasphalting?", Heavy Oils Conference, 1998, pp. 1-13.
H. Mei et al.: "A new method for obtaining ultra-low sulfur diesel fuel via ultrasound assisted oxidative desulfurization", Fuel, vol. 82, Oct. 22, 2002, pp. 405-414.
International Search Report and Written Opinion issued in PCT Application No. PCT/US2011/050590, dated Nov. 22, 2011 (6 pages).
M. Sattarin et al.: "Solvent Deasphalting of Vacuum Residue in a Bench-scale Unit", Petroleum & Coal, vol. 48, No. 3, Dec. 31, 2006, pp. 14-19.
International Search Report and Written Opinion dated May 24, 2018 for corresponding PCT/US2018/022134.

* cited by examiner

PROCESS FOR OXIDATIVE DESULFURIZATION AND SULFONE DISPOSAL USING SOLVENT DEASPHALTING

CROSS REFERENCE TO RELATED APPLICATION

This application is a continuation-in-part application of U.S. patent application Ser. No. 12/876,636 filed on Sep. 7, 2010, entitled "Process for Oxidative Desulfurization and Sulfone Disposal Using Solvent Deasphalting," which will issue as U.S. Pat. No. 9,598,647, on Mar. 21, 2017, which is hereby incorporated by reference in its entirety into this application.

FIELD

Embodiments relate to a method and apparatus for desulfurizing a hydrocarbon feedstock. More specifically, embodiments relate to a method and apparatus for oxidative desulfurization of a hydrocarbon stream and the subsequent disposal of resulting oxidized sulfur and nitrogen compounds.

BACKGROUND

Crude oil is the world's main source of hydrocarbons used as fuel and petrochemical feedstock. At the same time, petroleum and petroleum-based products are also a major source for air and water pollution today. To address growing concerns surrounding pollution caused by petroleum and petroleum-based products, many countries have implemented strict regulations on petroleum products, particularly on petroleum-refining operations and the allowable concentrations of specific pollutants in fuels, such as the allowable sulfur and nitrogen content in gasoline fuels. While the exact compositions of natural petroleum or crude oils vary significantly, all crude oils contain some measurable amount of sulfur compounds and most crude oils also contain some measurable amount of nitrogen compounds. In addition, crude oils may also contain oxygen, but the oxygen content of most crude is low. Generally, sulfur concentrations in crude oils are less than about 5 percent by weight (wt %), with most crude oils having sulfur concentrations in the range from about 0.5 to about 1.5 wt %. Nitrogen concentrations of most crude oils are usually less than 0.2 wt %, but can be as high as 1.6 wt %. In the United States, motor gasoline fuel is regulated to have a maximum total sulfur content of less than 10 parts per million weight (ppmw) sulfur, thus the removal of sulfur is a key concern.

Crude oils are refined in oil refineries to produce transportation fuels and petrochemical feedstocks. Typically, fuels for transportation are produced by processing and blending of distilled fractions from the crude oil to meet the particular end use specifications. Because most of the crudes generally available today have high concentrations of sulfur, the distilled fractions typically require desulfurization to yield products, which meet various performance specifications, environmental standards, or both.

The sulfur-containing organic compounds present in crude oils and resulting refined fuels can be a major source of environmental pollution. The sulfur compounds are typically converted to sulfur oxides during the combustion process, which in turn can produce sulfur oxyacids and contribute to particulate emissions, both of which are desired to be reduced.

One method for reducing particulate emissions includes the addition of various oxygenated fuel blending compounds, compounds that contain few or no carbon-to-carbon chemical bonds, such as methanol and dimethyl ether, or both. Most of these compounds, however, suffer in that they can have high vapor pressures, are nearly insoluble in diesel fuel, or have poor ignition quality, as indicated by their cetane numbers, or combinations thereof.

Hydrotreating and hydrogenation are alternate techniques currently used for the removal of sulfur and/or nitrogen from hydrocarbons. Diesel fuels that have been treated by chemical hydrotreating or hydrogenation to reduce their sulfur and aromatics contents can have a reduced fuel lubricity, which in turn can cause excessive wear of fuel pumps, injectors, and other moving parts that come in contact with the fuel under high pressures.

For example, middle distillates (that is, a distillate fraction that nominally boils in the range of about 180-370° C.) can be used as a fuel, or alternatively can be used as a blending component of fuel for use in compression ignition internal combustion engines (that is, diesel engines). The middle distillate fraction typically includes between about 1 and 3 wt % sulfur. Allowable sulfur concentration in middle distillate fractions were reduced to 5-50 ppmw levels from 3000 ppmw level since 1993 in Europe and United States to between a currently allowed amount of about 5-50 ppmw levels from the 3000 ppmw level.

Current conventional techniques for the removal of sulfur and nitrogen compounds typically still require the subsequent disposal of the sulfur and nitrogen compounds that are removed from the hydrocarbons. In order to comply with the increasingly stringent regulations for ultra-low sulfur content fuels, refiners must make fuels having even lower sulfur levels at the refinery gate so that they can meet the specifications after blending.

Low pressure conventional hydrodesulfurization (HDS) processes can be used to remove a major portion of the sulfur from petroleum distillates for the blending of refinery transportation fuels. These units, however, are not efficient to remove sulfur from compounds at mild conditions (that is, up to about 30 bar pressure), when the sulfur atom is sterically hindered as in multi-ring aromatic sulfur compounds. This is particularly true where the sulfur heteroatom is hindered by two alkyl groups (for example, 4,6-dimethyldibenzothiophene). Because of the difficulty in the removal, the hindered dibenzothiophenes predominate at low sulfur levels, such as 50 ppmw to 100 ppmw. Severe operating conditions (for example, high hydrogen partial pressure, high temperature, or high catalyst volume) must be utilized in order to remove the sulfur from these refractory sulfur compounds. Increasing the hydrogen partial pressure can only be achieved by increasing the recycle gas purity, or new grassroots units must be designed, which can be a very a costly option. The use of severe operating conditions typically results in decreased yield, lower catalyst life cycle, and product quality deterioration (for example, color), and therefore are typically sought to be avoided.

Conventional methods for petroleum upgrading, however, suffer from various limitations and drawbacks. For example, hydrogenative methods typically require large amounts of hydrogen gas to be supplied from an external source to attain desired upgrading and conversion. These methods can also suffer from premature or rapid deactivation of catalyst, as is typically the case during hydrotreatment of a heavy feedstock or hydrotreatment under harsh conditions, thus requiring regeneration of the catalyst or addition of new catalyst, which in turn can lead to process unit downtime. Thermal methods frequently suffer from the production of large amounts of coke as a byproduct and a limited ability to remove impurities, such as, sulfur and nitrogen. Additionally, thermal methods require specialized equipment suitable for severe conditions (for example, high temperature and high pressure), and require the input of significant energy, thereby resulting in increased complexity and cost.

Thus, there exists a need to provide a process for the upgrading of hydrocarbon feedstocks, particularly processes for the desulfurization, denitrogenation, or both, of hydrocarbons that use low severity conditions that can also provide means for the recovery and disposal of usable sulfur or nitrogen compounds, or both.

SUMMARY

Embodiments provide a method and apparatus for the upgrading of a hydrocarbon feedstock that removes a major portion of the sulfur-containing compounds present in the feedstock and in turn utilizes these sulfur-containing compounds in an associated process. Removal of nitrogen-containing compounds from the feedstock can similarly be achieved by the method and apparatus.

According to at least one embodiment, there is provided a method of upgrading a hydrocarbon feedstock, including supplying the hydrocarbon feedstock to an oxidation reactor, where the hydrocarbon feedstock including sulfur-containing compounds and nitrogen-containing compounds; and contacting the hydrocarbon feedstock with an oxidant in the presence of a catalyst in the oxidation reactor under conditions sufficient to selectively oxidize sulfur-containing compounds present in the hydrocarbon feedstock to produce an oxidized hydrocarbon stream that includes hydrocarbons, oxidized sulfur-containing compounds, and oxidized nitrogen-containing compounds. The method further includes separating the hydrocarbons and the oxidized sulfur- and nitrogen-containing compounds in the oxidized hydrocarbon stream by solvent extraction with a polar solvent to produce an extracted hydrocarbon stream and a mixed stream, the mixed stream including the polar solvent, where the oxidized sulfur-containing compounds, and the oxidized nitrogen-containing compounds, wherein the extracted hydrocarbon stream has a lower concentration of sulfur and nitrogen than the hydrocarbon feedstock. Further, the method includes separating the mixed stream using a distillation column into a first recovered polar solvent stream and a first residue stream; and supplying the first residue stream to a deasphalting unit to produce a deasphalted oil stream and a pitch stream, where the pitch stream includes a substantial portion of the oxidized sulfur-containing compounds and the nitrogen-containing compounds removed from the hydrocarbon feedstock. The method further includes supplying the extracted hydrocarbon stream to an adsorption column, the adsorption column being charged with an adsorbent suitable for the removal of oxidized compounds present in the extracted hydrocarbon stream, the adsorption column producing a high purity hydrocarbon product stream and a second residue stream, the second residue stream containing a portion of the oxidized sulfur-containing compounds and the oxidized nitrogen-containing compounds, and a spent adsorbent stream, the spent adsorbent stream containing another portion of the oxidized sulfur-containing compounds and the oxidized nitrogen-containing compounds; and supplying the spent adsorbent stream to the deasphalting unit to remove contaminants from the deasphalted oil in the deasphalting unit.

According to at least one embodiment, the method further includes recycling a portion of the high purity hydrocarbon product stream to the oxidation reactor.

According to at least one embodiment, the method further includes supplying the extracted hydrocarbon stream to a stripper to produce a second recovered polar solvent stream and a stripped hydrocarbon stream.

According to at least one embodiment, the method further includes recycling the first recovered polar solvent stream and the second polar solvent stream to an extraction vessel for the step of separating the hydrocarbons and the oxidized sulfur compounds in the oxidized hydrocarbon stream.

According to at least one embodiment, the oxidant is selected from the group consisting of air, oxygen, oxides of nitrogen, peroxides, hydroperoxidies, organic peracids, and combinations thereof.

According to at least one embodiment, the catalyst is a metal oxide having the formula $M_xO_y$, wherein M is an element selected from Groups IVB, VB, and VIB of the periodic table.

According to at least one embodiment, the oxidation reactor is maintained at a temperature of between about 20° C. and about 150° C. and at a pressure of between about 1 bar and about 10 bars.

According to at least one embodiment, the ratio of the oxidant to sulfur containing compounds present in the hydrocarbon feedstock is between about 4:1 and 10:1.

According to at least one embodiment, the polar solvent has a Hildebrandt value of greater than about 19.

According to at least one embodiment, the polar solvent is selected from the group consisting of acetone, carbon disulfide, pyridine, dimethyl sulfoxide, n-propanol, ethanol, n-butanol, propylene glycol, ethylene glycol, dimethlyformamide, acetonitrile, methanol and combinations of the same.

According to at least one embodiment, the polar solvent is acetonitrile.

According to at least one embodiment, the polar solvent is methanol.

According to at least one embodiment, the solvent extraction is conducted at a temperature of between about 20° C. and about 60° C. and at a pressure of between about 1 bar and about 10 bars.

According to at least one embodiment, the method further includes supplying the second residue stream to the deasphalting unit.

According to at least one embodiment, the adsorbent is selected from the group consisting of activated carbon, silica gel, alumina, natural clays, zeolites; fresh, used, regenerated, or rejuvenated catalysts, and combinations of the same.

According to at least one embodiment, the adsorbent is a polymer coated support, wherein the support has a high surface area and is selected from the group consisting of silica gel, alumina, and activated carbon, and the polymer is selected from the group consisting of polysulfone, polyacrylonitrile, polystyrene, polyester terephthalate, polyurethane and combinations of the same.

According to at least one embodiment, the supplying the first residue stream to the deasphalting unit further includes supplying a deasphalting solvent selected from a paraffinic solvent having between 3 and 7 carbon atoms to the deasphalting unit and extracting the first residue stream with the deasphalting solvent at a temperature and pressure at or below the critical temperature and pressure of the paraffinic solvent, wherein the deasphalted oil stream includes a major fraction of the paraffinic solvent.

According to another embodiment, there is provided a method of upgrading a hydrocarbon feedstock, including supplying the hydrocarbon feedstock to an oxidation reactor, the hydrocarbon feedstock including sulfur-containing compounds; catalytically oxidizing the sulfur-containing compounds in the hydrocarbon feedstock in the oxidation reactor with an oxidant in the presence of a catalyst under conditions sufficient to selectively oxidize the sulfur-containing compounds present in the hydrocarbon feedstock to sulfones and produce a treated hydrocarbon stream including hydrocarbons and sulfones and a waste catalyst stream; and extracting the treated hydrocarbon stream with a polar solvent to produce an extracted hydrocarbon stream and a mixed stream, the mixed stream including the polar solvent and the sulfones, where the extracted hydrocarbon stream has a lower sulfur concentration than the hydrocarbon feedstock. The method further includes separating the mixed stream using a solvent regeneration column into a recovered polar solvent stream and a residue stream including sulfones; supplying the residue stream including sulfones to a deasphalting unit and extracting the residue stream with a paraffinic solvent having between 3 and 7 carbon atoms to produce a deasphalted oil stream and a pitch stream, where the extraction of the residue stream is conducted a temperature and pressure that is at or below the supercritical temperature and pressure of the paraffinic solvent; and supplying the extracted hydrocarbon stream to a distillation column and separating the extracted hydrocarbon stream into a high purity hydrocarbon product stream and a desulfurized deasphalted oil stream.

According to at least one embodiment, the method further includes recycling the deasphalted oil stream to the oxidation reactor.

According to at least one embodiment, the hydrocarbon feedstock further includes nitrogen-containing compounds, such that the step of catalytically oxidizing further includes catalytically oxidizing the nitrogen-containing compounds in the hydrocarbon feedstock with the oxidant in the presence of the catalyst, and wherein the residue stream supplied to the deasphalting unit includes the oxidized nitrogen-containing compounds.

According to at least one embodiment, the oxidation reactor is maintained at a temperature of between about 20° C. and about 150° C. and at a pressure of between about 1 bar and about 10 bars and the solvent extraction is conducted at a temperature of between about 20° C. and about 60° C. and at a pressure of between about 1 bar and about 10 bars.

According to at least one embodiment, the polar solvent has a Hildebrandt value of greater than about 19.

According to at least one embodiment, the polar solvent is methanol.

According to at least one embodiment, the polar solvent is acetonitrile.

BRIEF DESCRIPTION OF DRAWINGS

So that the manner in which the features and advantages of the method and system disclosed, as well as others which will become apparent, may be understood in more detail, a more particular description of the method and system briefly summarized previously may be had by reference to the embodiments thereof which are illustrated in the appended drawings, which form a part of this specification. It is to be noted, however, that the drawings illustrate only various embodiments and are therefore not to be considered limiting of the scope as it may include other effective embodiments as well. Like numbers refer to like elements throughout, and the prime notation, if used, indicates similar elements in alternative embodiments or positions.

DETAILED DESCRIPTION

Although the following detailed description contains many specific details for purposes of illustration, it is understood that one of ordinary skill in the art will appreciate that many examples, variations and alterations to the following details are within the scope and spirit. Accordingly, the various embodiments described and provided in the appended figures are set forth without any loss of generality, and without imposing limitations, relating to the claims.

Embodiments address known problems associated with conventional methods of upgrading and recovering compounds from a hydrocarbon feedstock, particularly the desulfurization, denitrogenation, or both, of hydrocarbon feedstocks, and the subsequent removal and recovery of usable hydrocarbons. According to at least one embodiment, there is provided a method for the removal of sulfur and nitrogen compounds from a hydrocarbon feedstock and the use of oxidized sulfur species and oxidized nitrogen species in a deasphalting process.

As used, the terms "upgrading" or "upgraded," with respect to petroleum or hydrocarbons refers to a petroleum or hydrocarbon product that is lighter (that is, has fewer carbon atoms, such as methane, ethane, and propane), has at least one of a higher API gravity, higher middle distillate yield, lower sulfur content, lower nitrogen content, or lower metal content, than does the original petroleum or hydrocarbon feedstock.

As used, an oxidized sulfur- and oxidized nitrogen-containing hydrocarbon stream refers to a hydrocarbon stream that includes the oxidized sulfur- or oxidized nitrogen-containing compounds, or both.

Figure 1:
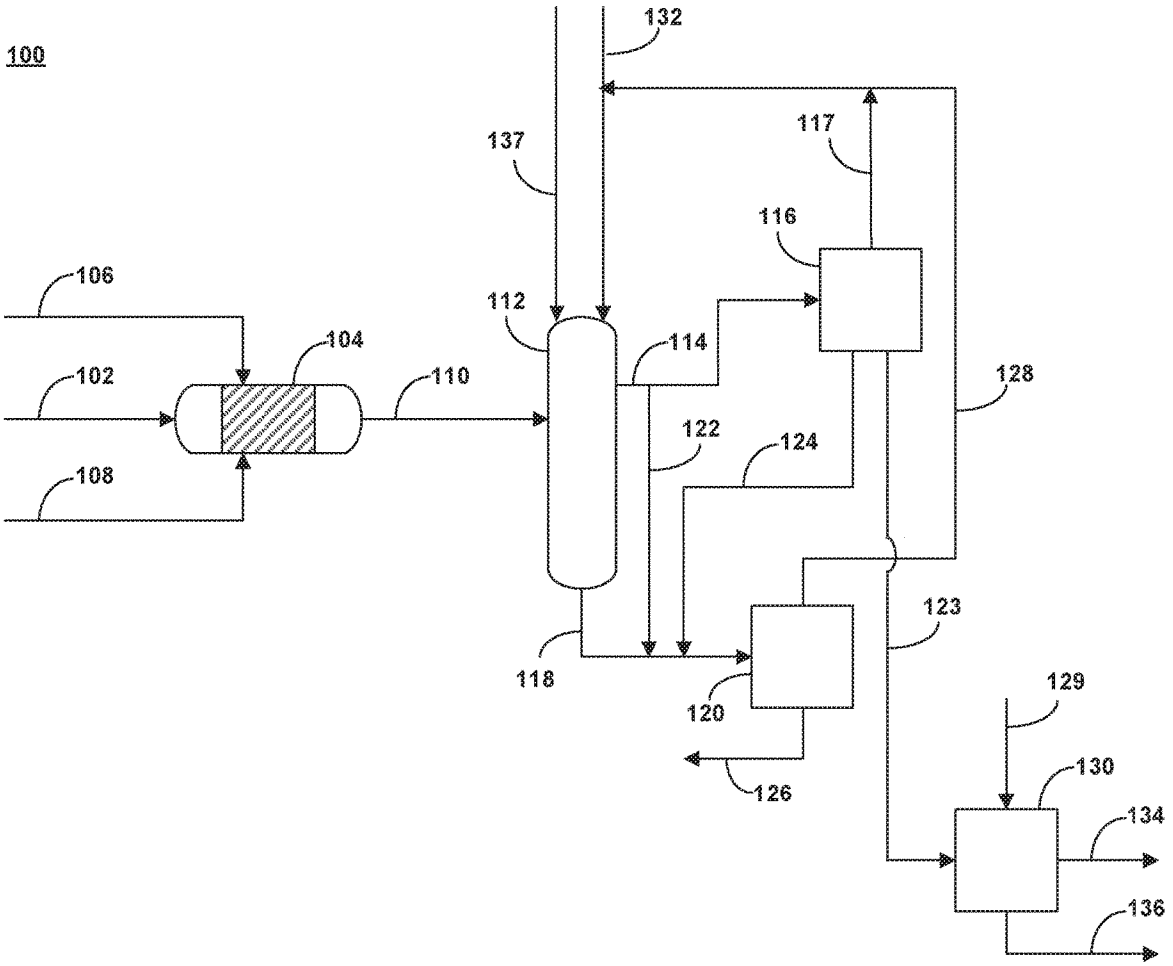
FIG. 1 provides a schematic diagram of one embodiment of the method of upgrading a hydrocarbon feedstock.

FIG. 1 provides a schematic diagram of one embodiment of the method of upgrading a hydrocarbon feedstock. Hydrocarbon upgrading system 100 includes oxidation reactor 104, extraction vessel 112, solvent regeneration column 116, stripper 120, and deasphalting unit 130.

According to at least one embodiment, there is provided a method for the upgrading of a hydrocarbon feedstock, particularly a hydrocarbon feedstock that includes sulfur- and nitrogen-containing compounds. The method includes supplying hydrocarbon feedstock 102 to oxidation reactor 104, where the hydrocarbon feedstock is contacted with an oxidant and a catalyst. The oxidant can be supplied to oxidation reactor 104 via oxidant feed line 106 and fresh catalyst can be supplied to the reactor via catalyst feed line 108. In certain embodiments, the catalyst can be regenerated using the process described below, and supplied along with, or in the place of, fresh catalyst.

According to at least one embodiment, hydrocarbon feedstock 102 can be any petroleum based hydrocarbon, and can include various impurities, such as elemental sulfur, compounds that include sulfur or nitrogen, or both. In certain embodiments, hydrocarbon feedstock 102 can be a diesel oil having a boiling point between about 150° C. and about 400° C. Alternatively, hydrocarbon feedstock 102 can have a boiling point up to about 450° C., alternatively up to about 500° C. Alternatively, hydrocarbon feedstock 102 can have a boiling point between about 100° C. and about 500° C. Optionally, hydrocarbon feedstock 102 can have a boiling point up to about 600° C., alternatively up to about 700° C., or, in certain embodiments, greater than about 700° C. According to at least one embodiment, the feedstock exists in a solid state after distillation called residue. In certain embodiments, hydrocarbon feedstock 102 can include heavy hydrocarbons. As used, heavy hydrocarbons refer to hydrocarbons having a boiling point of greater than about 360° C., and can include aromatic hydrocarbons and naphthenes, as well as alkanes and alkenes. Generally, in certain embodiments, hydrocarbon feedstock 102 can be selected from whole range crude oil, topped crude oil, product streams from oil refineries, product streams from refinery steam cracking processes, liquefied coals, hydrocarbon fractions, such as diesel and vacuum gas oil boiling in the range of about 180 to about 370° C. and about 370 to about 520° C., respectively, and the like, and mixtures thereof Sulfur compounds present in hydrocarbon feedstock 102 can include sulfides, disulfides, and mercaptans, as well as aromatic molecules such as thiophenes, benzothiophenes, dibenzothiophenes, and alkyl dibenzothiophenes, such as 4,6-dimethyl-dibenzothiophene. Aromatic compounds are typically more abundant in higher boiling fractions, than is typically found in the lower boiling fractions.

Nitrogen-containing compounds present in hydrocarbon feedstock 102 can include basic and neutral nitrogen compounds, including indoles, carbazoles, anilines, quinolines, acridines, and the like, and mixtures thereof.

According to at least one embodiment, oxidation reactor 104 can be operated at mild conditions, relative to the conditions typically used in conventional hydrodesulfurization processes for diesel type feedstock. More specifically, in certain embodiments, oxidation reactor 104 can be maintained at a temperature of between about 20° C. and about 150° C., alternatively between about 30° C. and about 150° C., alternatively between about 30° C. and about 90° C., or between about 90° C. and about 150° C. In certain embodiments, the temperature is preferably between about 30° C. and about 75° C., more preferably between about 45° C. and about 60° C. The operating pressure of oxidation reactor 104 can be between about 1 bar and about 30 bars, alternatively between about 1 bar and about 15 bars, alternatively between about 1 bar and about 10 bars, and alternatively between about 2 bars and about 3 bars. The residence time of the hydrocarbon feedstock within oxidation rector 102 can be between about 1 minute and about 180 minutes, alternatively between about 15 minutes and about 180 minutes, alternatively between about 15 minutes and about 90 minutes, alternatively between about 5 minutes and about 60 minutes, alternatively between about 30 minutes and about 60 minutes, alternatively between about 60 minutes and about 120 minutes, alternatively between about 120 minutes and about 180 minutes, and is preferably for a sufficient amount of time for the oxidation of any sulfur- or nitrogen-containing compounds present in the hydrocarbon feedstock 102. In one embodiment, the residence time of the hydrocarbon feedstock within oxidation rector 104 is between about 15 minutes and about 45 minutes. For comparison, conventional hydrodesulfurization of a diesel type feedstock is typically conducted under harsher conditions, for example, at temperatures of between about 330° C. and about 380° C., pressures of between about 50 bars and about 80 bars, and liquid hourly space velocity (LHSV) of between about 0.5 $h^{-1}$ and about 2 $h^{-1}$.

According to at least one embodiment, oxidation reactor 104 can be any reactor suitably configured to ensure sufficient contacting between hydrocarbon feedstock 102 and the oxidant, in the presence of a catalyst, for the oxidation of the sulfur- and nitrogen-containing compounds. Suitable reactors for oxidation reactor 104 can include, for example, batch reactors, fixed bed reactors, ebullated bed reactors, lifted reactors, fluidized bed reactors, slurry bed reactors, and the like. Sulfur and nitrogen compounds present in hydrocarbon feedstock 102 are oxidized in oxidation reactor 104 to sulfones, sulfoxides, and oxidized nitrogen compounds, which can be subsequently removed by extraction or adsorption. Oxidized nitrogen compounds can include, for example, pyridine and pyrrole-based compounds or pyridine-difuran compounds. Frequently, during oxidation, the nitrogen atom itself is not oxidized, but rather the compound is oxidized to a compound that is easy to separate from the remaining compounds.

According to at least one embodiment, the oxidant is supplied to oxidation reactor 104 via oxidant feed stream 106. Suitable oxidants can include air, oxygen, hydrogen peroxide, organic peroxides, hydroperoxides, organic peracids, peroxo acids, oxides of nitrogen, ozone, and the like, and combinations thereof. Peroxides can be selected from hydrogen peroxide and the like. Hydroperoxides can be selected from t-butyl hydroperoxide and the like. Organic peracids can be selected from peracetic acid and the like.

In certain embodiments, such as hydrocarbon feedstocks having a greater concentration of sulfur than nitrogen, the mole ratio of oxidant to sulfur present in the hydrocarbon feedstock can be from about 1:1 to 50:1, preferably between about 2:1 and 20:1, more preferably between about 4:1 and 10:1.

In certain other embodiments, such as hydrocarbon feedstocks having a greater concentration of nitrogen than sulfur, for example, certain South American crude oils, certain African crude oils, certain Russian crude oils, certain Chinese crude oils, and certain intermediate refinery streams like coker, thermal cracking, visbreaking, FCC cycle oils, and the like, the mole ratio of oxidant to nitrogen present in the hydrocarbon feedstock can be from about 1:1 to 50:1, preferably between about 2:1 and 20:1, more preferably between about 4:1 and 10:1.

According to at least one embodiment, the catalyst can be supplied to oxidation reactor 104 via catalyst feed stream 108. The catalyst can be a homogeneous catalyst. The catalyst can include at least one metal oxide having the chemical formula $M_xO_y$, wherein M is a metal selected from groups IVB, VB, or VIB of the periodic table. Metals can include titanium, vanadium, chromium, molybdenum, and tungsten. Molybdenum and tungsten are two particularly effective catalysts that can be used in various embodiments. In certain embodiments, the spent catalyst can be rejected from the system with the aqueous phase (for example, when using an aqueous oxidant) after the oxidation vessel.

According to at least one embodiment, such as the use of aqueous oxidants, spent catalyst can be removed from the system with the aqueous phase, after the oxidation vessel. Catalyst remaining in the hydrocarbon stream can be removed or disposed of in the solvent deasphalting step. In certain embodiments, the catalyst can be regenerated and recycled. In certain other embodiments, the catalyst is not regenerated and is not recycled.

According to at least one embodiment, the ratio of catalyst to oil is between about 0.01% by weight and about 10% by weight, preferably between about 0.5% by weight and about 5% by weight. In certain embodiments, the ratio is between about 0.5% by weight and about 2.5% by weight. Alternatively, the ratio is between about 2.5% by weight and about 5% by weight. Other suitable weight ratios of catalyst to oil will be apparent to those of skill in the art and are to be considered within the scope of the various embodiments.

Catalyst present in oxidation reactor 104 can increase the rate of oxidation of the various sulfur- and nitrogen-containing compounds in hydrocarbon feedstock 102, thereby achieving completion of the reaction and oxidation of sulfur- and nitrogen-containing compounds in a shorter amount of time, and reducing the amount of oxidant necessary to achieve oxidation of the sulfur- and nitrogen-containing compounds. In certain embodiments, the catalyst may have increased selectivity toward the oxidation of sulfur-containing or nitrogen-containing species, or both. In other embodiments, the catalyst is selective to the minimization of oxidation of aromatic hydrocarbons.

The composition of spent oxidant will vary based upon what original oxidant is used in the process. For example, in embodiments wherein the oxidant is hydrogen peroxide, water is formed as a by-product of the oxidation reaction. In embodiments where the oxidant is an organic peroxide, alcohol is formed as a by-product of the oxidation reaction. By-products are typically removed during the extraction and solvent recovery steps.

According to at least one embodiment, oxidation reactor 104 produces oxidized sulfur- and oxidized nitrogen-containing hydrocarbon stream 110, which can include oxidized sulfur- and oxidized nitrogen-containing hydrocarbon species. Oxidized sulfur- and oxidized nitrogen-containing hydrocarbon stream 110 is supplied to extraction vessel 112 where the oxidized sulfur- and oxidized nitrogen-containing hydrocarbon species are contacted with extraction solvent stream 137. Extraction solvent 137 can be a polar solvent, and in certain embodiments, can have a Hildebrandt solubility value of greater than about 19. In certain embodiments, when selecting the particular polar solvent for use in extracting oxidized sulfur- and oxidized nitrogen-containing species, selection can be based upon, in part, solvent density, boiling point, freezing point, viscosity, and surface tension, as non-limiting examples. Polar solvents suitable for use in the extraction step can include acetone (Hildebrand value of 19.7), carbon disulfide (20.5), pyridine (21.7), dimethyl sulfoxide (DMSO) (26.4), n-propanol (24.9), ethanol (26.2), n-butyl alcohol (28.7), propylene glycol (30.7), ethylene glycol (34.9), dimethylformamide (DMF) (24.7), acetonitrile (30), methanol (29.7), and like compositions or compositions having similar physical and chemical properties. In certain embodiments, acetonitrile and methanol, due to their low cost, volatility, and polarity, are preferred. Methanol is a particularly suitable solvent for use in embodiments. In certain embodiments, solvents that include sulfur, nitrogen, or phosphorous, preferably have a relatively high volatility to ensure adequate stripping of the solvent from the hydrocarbon feedstock.

According to at least one embodiment, the extraction solvent is non-acidic and the extraction step is conducted in an acid-free environment. The use of acids is typically avoided due to the general corrosive nature of acids, and the requirement that all equipment be specifically designed for a corrosive environment. In addition, acids, such as acetic acid, can present difficulties in separation due to the formation of emulsions.

According to at least one embodiment, extraction vessel 112 can be operated at a temperature of between about 20° C. and about 60° C., preferably between about 25° C. and about 45° C., even more preferably between about 25° C. and about 35° C. Extraction vessel 112 can operate at a pressure of between about 1 bars and about 10 bars, preferably between about 1 bar and about 5 bars, more preferably between about 1 bar and about 2 bars. In certain embodiments, extraction vessel 112 operates at a pressure of between about 2 bars and about 6 bars.

According to at least one embodiment, the ratio of the extraction solvent to hydrocarbon feedstock can be between about 1:3 and 3:1, preferably between about 1:2 and 2:1, more preferably about 1:1. Contact time between the extraction solvent and the oxidized sulfur and oxidized nitrogen containing hydrocarbon stream 110 can be between about 1 second and 60 minutes, preferably between about 1 second and about 10 minutes. In certain embodiments, the contact time between the extraction solvent and oxidized sulfur and oxidized nitrogen containing hydrocarbon stream 110 is less than about 15 minutes. In certain embodiments, extraction vessel 112 can include various means for increasing the contact time between the extraction solvent and oxidized sulfur- and oxidized nitrogen-containing hydrocarbon stream 110, or for increasing the degree of mixing of the two solvents. Means for mixing can include mechanical stirrers or agitators, trays, or like means.

According to at least one embodiment, extraction vessel 112 produces mixed stream 114 that can include extraction solvent, oxidized species (for example, the oxidized sulfur and nitrogen containing hydrocarbon species that were originally present in hydrocarbon feedstock 102), and the hydrocarbon feedstock 102, and extracted hydrocarbon stream 118, which can include the hydrocarbon feedstock having a reduced concentration of sulfur- and nitrogen-containing hydrocarbons, relative to hydrocarbon feedstock 102. Typically, the hydrocarbon feedstock is only present in mixed stream 114 in trace amounts.

Mixed stream 114 can be supplied to solvent regeneration column 116 where extraction solvent can be recovered as first recovered solvent stream 117 and separated from first residue stream 123, which includes oxidized sulfur- and nitrogen-containing hydrocarbon compounds. Optionally, mixed stream 114 can be separated in solvent regeneration column 116 into a recovered hydrocarbon stream 124, which can include hydrocarbons present in mixed stream 114 from hydrocarbon feedstock 102. Solvent regeneration column 116 can be a distillation column that is configured to separate mixed stream 114 into first recovered solvent stream 117, first residue stream 123, and recovered hydrocarbon stream 124.

Extracted hydrocarbon stream 118 can be supplied to stripper 120, which can be a distillation column or like vessel designed to separate a hydrocarbon product stream from residual extraction solvent. In certain embodiments, a portion of mixed stream 114 can optionally be supplied to stripper 120 via line 122, and where it can be combined with extracted hydrocarbon stream 118. In certain embodiments, solvent regeneration column 116 can produce recovered hydrocarbon stream 124, which can be supplied to stripper 120, where the recovered hydrocarbon stream can optionally be contacted with extracted hydrocarbon stream 118 or a portion of mixed stream 114, which can be supplied to stripper 120 via line 122.

Stripper 120 separates the various streams supplied thereto into stripped oil stream 126, which includes hydrocarbons present in hydrocarbon feedstock 102 and has a reduced sulfur and nitrogen content relative thereto, and second recovered solvent stream 128.

Stripper 120 separates the various streams supplied thereto into stripped oil stream 126, which includes hydrocarbons present in hydrocarbon feedstock 102 and has a reduced sulfur and nitrogen content relative thereto, and second recovered solvent stream 128.

In certain embodiments, first recovered solvent stream 117 can be combined with second recovered solvent stream 128 and recycled to extraction vessel 112. Optionally, make-up solvent stream 132, which can include fresh solvent, can be combined with first recovered solvent stream 117, second recovered solvent stream 128, or both, and supplied to extraction vessel 112. Alternately, extraction vessel 112 can be supplied completely with a polar solvent recovered from stream 117, second recovered solvent stream 128, or both.

First residue stream 123, which includes oxidized sulfur- and nitrogen-containing compounds, and which can also include low concentrations of hydrocarbonaceous material, can be supplied to deasphalting unit 130 where the solvent deasphalting process can be used to prepare valuable products for use as a source of road asphalt. Specifically, oxidized compounds such as the oxidized sulfur-containing hydrocarbons, for example sulfones, and oxidized nitrogen-containing compounds, can be included in road asphalt compositions. The use of the oxidized compounds in asphalt compositions can reduce or eliminate the need to use alternative methods for the removal of the oxidized sulfur- and oxidized nitrogen-containing species, such as a conventional hydrotreating step employing the addition of hydrogen or disposal of hydrogen sulfide via a Claus unit. According to at least one embodiment, oxidized sulfur-containing compounds, such as sulfones, are embedded in heavy hydrocarbons, such as hydrocarbons having a boiling point of greater than about 520° C., and subsequently used for the preparation of the asphalt road. Solvent deasphalting processes can also be used to produce feedstock for base oil production, or can be used to produce deasphalted or demetallized oil from heavy crude to produce fuel oil.

According to at least one embodiment, fresh residual oil stream 129 can also be sent to deasphalting unit 130 to assist in the solvent deasphalting process.

Solvent deasphalting results, for example, in the separation of compounds based upon solubility and polarity, rather than by boiling point, as is the case with the vacuum distillation processes that are currently used to produce a low-contaminant deasphalted oil (DAO), which can be rich in paraffinic-type hydrocarbon molecules. The lower molecular weight fractions can then be further processed in conventional conversion units, for example, a fluidic catalytic cracking (FCC) unit or hydrocracking unit. Solvent deasphalting usually can be carried out with paraffin solvent streams having between about 3 carbon atoms and about 7 carbon atoms, preferably between about 4 carbon atoms and 5 carbon atoms, at or below the critical conditions of the paraffin solvent.

According to at least one embodiment, a processed hydrocarbon feed is dissolved in the paraffin solvent, and an insoluble pitch precipitates. Separation of the DAO phase and the pitch phase can occur in an extractor (not shown), which can be designed to efficiently separate the two phases and minimize contaminant entrainment in the DAO phase. Typically, the DAO phase is heated to conditions, such that the extraction solvent reaches supercritical conditions. Under these conditions, the separation of the solvent and DAO is relatively easy. Solvent associated with the DAO and the pitch can be then stripped out at low pressure and recycled to the deasphalting unit 130.

Solvents for use in deasphalting unit 130 can include normal and isomerized paraffinic solvents having between about 3 carbon atoms and about 7 carbon atoms (that is, from propane to heptane), and mixtures thereof. Deasphalting unit 130 can be operated at or below the supercritical temperature of the solvent (that is, at or below about 97° C., 152° C., 197° C., 235° C., or 267° C. for propane, butane, pentane, hexane and heptane, respectively). Similarly, deasphalting unit 130 can be operated at a pressure at or below the supercritical pressure of the solvent (that is, at or below about 42.5, 38, 34, 30, and 27.5 bars for propane, butane, pentane, hexane and heptane, respectively).

Deasphalting unit 130 produces deasphalted oil stream 134, which includes usable hydrocarbons, and pitch stream 136, which can include metals, aromatic compounds, asphaltenes, and the oxidized sulfur and nitrogen compounds.

Figure 2:
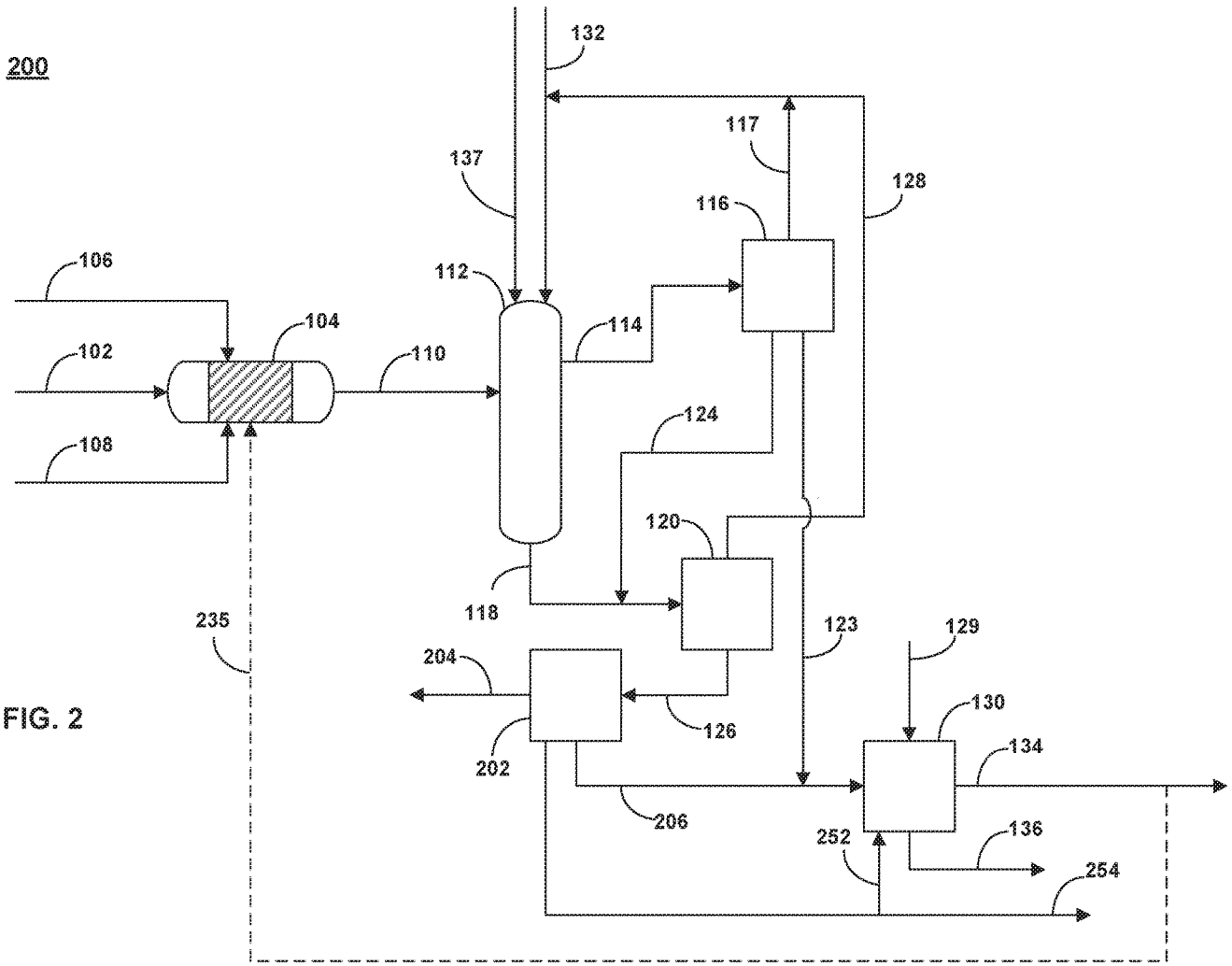
FIG. 2 provides a schematic diagram of one embodiment of the method of upgrading a hydrocarbon feedstock.

FIG. 2 provides another embodiment for the upgrading of hydrocarbons. Hydrocarbon upgrading system 200 includes oxidation reactor 104, extraction vessel 112, solvent regeneration column 116, stripper 120, deasphalting unit 130, and adsorption column 202.

As shown in FIG. 2, in certain embodiments of the invention, stripped oil stream 126 can be supplied to adsorption column 202, where stripped oil stream 126 can be contacted with one or more adsorbents designed to remove one or more of various impurities, such as sulfur-containing compounds, oxidized sulfur compounds, nitrogen-containing compounds, oxidized nitrogen compounds, and metals remaining in the hydrocarbon product stream after oxidation and solvent extraction steps.

According to various embodiments, the one or more adsorbents can include activated carbon; silica gel; alumina; natural clays; silica-alumina; zeolites; and fresh, used, regenerated or rejuvenated catalysts having affinity to remove oxidized sulfur and nitrogen compounds and other inorganic adsorbents. In certain embodiments, the adsorbent can include polar polymers that have been applied to or that coat various high surface area support materials, such as silica gel, alumina, and activated carbon. Example polar polymers for use in coating various support materials can include polysulfones, polyacrylonitrile, polystyrene, polyester terephthalate, polyurethane, other like polymer species that exhibit an affinity for oxidized sulfur species, and combinations thereof.

According to at least one embodiment, adsorption column 202 can be operated at a temperature of between about 20° C. and about 60° C., preferably between about 25° C. and about 40° C., even more preferably between about 25° C. and about 35° C. In certain embodiments, adsorption column 202 can be operated at a temperature of between about 10° C. and about 40° C. In certain embodiments, adsorption column 202 can be operated at temperatures of greater than about 20° C., or alternatively at temperatures less than about 60° C. Adsorption column 202 can be operated at a pressure of up to about 15 bars, preferably up to about 10 bars, even more preferably between about 1 bar and about 2 bars. In certain embodiments, adsorption column 202 can be operated at a pressure of between about 2 bars and about 5 bars. In accordance with at least one embodiment, adsorption column 202 can be operated at a temperature of between about 25° C. and about 35° C. and a pressure of between about 1 bar and about 2 bars. The weight ratio of the stripped oil stream to the adsorbent is between about 1:1 and about 20:1, alternately between about 5:1 and about 15:1. In alternate embodiments, the ratio is between about 7:1 and about 13:1, with a preferred ratio being about 10:1.

Adsorption column 202 separates the feed into extracted hydrocarbon product stream 204 having very low sulfur content (for example, less than 15 ppmw of sulfur) and very low nitrogen content (for example, less than 10 ppmw of nitrogen), a second residue stream 206, and spent adsorbent. Second residue stream 206 includes oxidized sulfur- and oxidized nitrogen-containing compounds, and as shown in FIG. 2 is directed to deasphalting unit 130. Optionally, second residue stream 206 can be combined with first residue stream 123 and supplied to deasphalting unit 130 and processed as noted previously.

As further shown in FIG. 2, according to at least one embodiment, the spent adsorbent can be supplied or recycled via stream 252 to deasphalting unit 130 to remove contaminants (for example, sulfur, nitrogen, metals, and polycyclic aromatics) from the deasphalted oil for improving deasphalted oil quality. The yield change may depend on the storage capacity left in the spent adsorbent pores. In particular, the spent adsorbent, for example, about 30 wt % to about 80 wt % partially used adsorbent, in stream 252 is supplied or recycled to deasphalting unit 130 to improve the quality of the deasphalted oil in stream 134, thereby disposing of the spent adsorbents. For example, sulfur can be reduced between about 20 wt % to about 50 wt %, nitrogen can be reduced between about 20 wt % to about 70 wt %, and micro carbon residue can be reduced between about 20 wt % to about 50 wt %, such that the yield loss for the deasphalted oil stream 134 can be between about 5 wt % to about 10 wt %, and the yield gain for the pitch stream 136 can be between about 5 wt % to about 10 wt %. Optionally, the spent adsorbent can be disposed via stream 254.

According to at least one embodiment, adsorption column 202 can be semi-continuously operated, such that two columns are used in a swing-mode operation, where one adsorption column is in operation, while another is being prepared. Adsorption column 202 can also be continuously monitored, so that spent adsorbent can be sent to deasphalting unit 130 prior to the completion of the life cycle of the spent adsorbent. According to at least one embodiment, fresh residual oil stream 129 can also be sent to deasphalting unit 130.

According to another embodiment, the spent adsorbent can be supplied at a predefined flow rate to a surge vessel (not shown) before being supplied or recycled to deasphalting unit 130.

As further shown in FIG. 2, according to at least one embodiment, a portion of the deasphalted oil stream 134 can be recycled via line 235 to oxidation reactor 104, where the portion of the deasphalted oil stream 134 can further be desulfurized in the oxidative desulfurized process occurring in oxidation reactor 104.

According to at least one embodiment, the adsorbent can be regenerated by contacting spent adsorbent with a polar solvent, such as methanol or acetonitrile, to desorb the adsorbed oxidized compounds from the adsorbent. According to at least one embodiment, heat, stripping gas, or both, can also be employed to facilitate the removal of the adsorbed compounds. Other suitable methods for removing the absorbed compounds will be apparent to those of skill in the art and are to be considered within the scope of the various embodiments.

EXAMPLE

Figure 3:
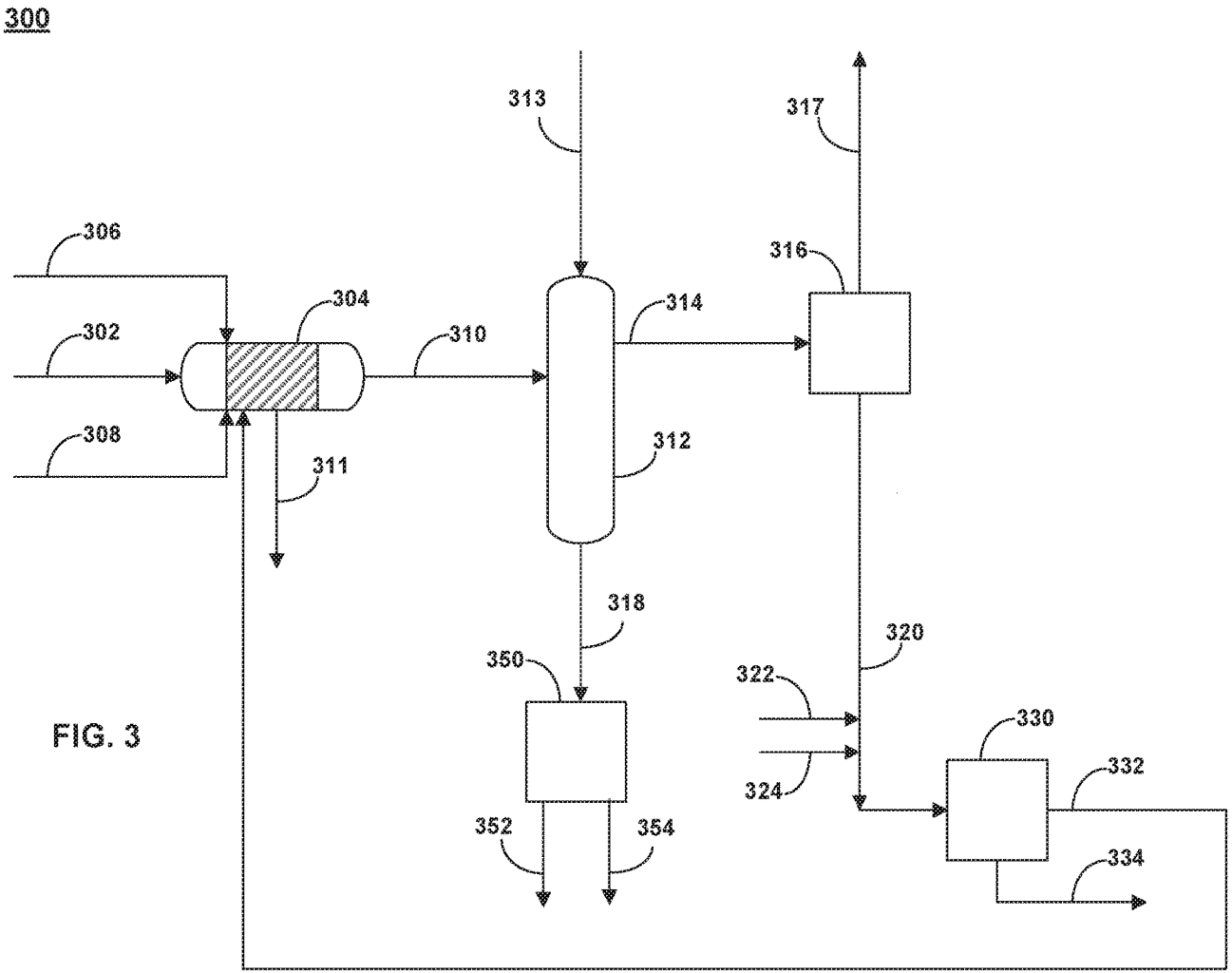
FIG. 3 provides a schematic diagram of one embodiment of the method of upgrading a hydrocarbon feedstock.

FIG. 3 provides a schematic diagram of another embodiment of the method of upgrading a hydrocarbon feedstock. Diesel stream 302, which includes sulfur-containing compounds, hydrogen peroxide oxidant stream 306 and catalyst stream 308, including acetic acid and $Na_2WO_4$ solid catalyst, were supplied to oxidation reactor 304, which was operated at conditions suitable to oxidize sulfur-containing compounds present in diesel stream 302, to produce oxidized sulfur-containing diesel stream 310 and waste catalyst stream 311. Oxidation reactor 304 was maintained at a temperature of about 70° C. and a pressure of about 1 bar. The hydrogen peroxide to sulfur ratio was about 4:1, and the reactants were contacted for approximately 60 min. Oxidized sulfur-containing diesel stream 310 was supplied to extraction vessel 312 where diesel stream 302 was contacted with methanol and heated to selectively remove the oxidized sulfur-containing compounds from diesel stream 310. Extraction vessel 312 was operated as described previously and produces extracted diesel stream 318 as a product stream, from which at least a portion of the sulfur-containing compounds have been removed, and mixed stream 314, which includes oxidized sulfur compounds and methanol, and may also include trace amounts of diesel. The extraction was conducted at a temperature of about 25° C. and a pressure of about 1 bar, wherein the solvent to feed ratio was approximately 1:1 and the contact time between the extraction solvent and the feed was approximately 30 seconds.

Mixed stream 314 was supplied to solvent regeneration column 316, where methanol stream 317 is separated from residue stream 320, which includes oxidized sulfur-containing compounds, and may also include heavy hydrocarbons. Solvent regeneration column 316 was operated at a temperature of about 50° C. and a pressure of about 1 bar. Residue stream 320 was combined with pentane stream 322 and vacuum residue stream 324 and supplied to solvent deasphalting unit 330 to produce deasphalted oil stream 332, which includes DAO derived primarily from the vacuum residue stream, and asphaltene stream 334, which includes oxidized sulfur-containing compounds. Solvent deasphalting unit 330 was operated at a temperature of about 160° C. and a pressure of about 24 bars. The solvent to feed ratio was about 5% by volume. The solvent comprised pentanes, consisting of about 86.8% by volume n-C4, about 2.6% by volume i-C5, and about 0.5% by volume n-C5.

Tables 1-3 provide the compositions of the various streams for the Example illustrated with FIG. 3. For example, Table 1 shows the composition of the input and output streams for the oxidation step. Table 2 shows the composition of the input and output streams for the extraction step. Table 3 shows the composition of the input and output streams for the solvent deasphalting step.

TABLE 1

| Oxidation | | | | | |
|---|---|---|---|---|---|
| Stream | 302 (diesel) Kg/h | 306 ($H_2O_2$) Kg/h | 308 (catalyst) Kg/h | 311 (catalyst waste) Kg/h | 310 (oxidized sulfur containing diesel stream) Kg/h |
| Water | 0 | 974 | 0 | 8,750 | 0 |
| Methanol | 0 | 0 | 0 | 0 | 0 |
| Diesel | 171,915 | 0 | 0 | 0 | 171,915 |
| Organic Sulfur | 519 | 0 | 0 | 2 | 517 |
| Acetic Acid | 0 | 0 | 10,641 | 10,641 | 0 |
| $H_2O_2$ | 0 | 292 | 0 | 0 | 0 |
| $Na_2WO_4$ (Kg) | 0 | 0 | 4,794 | 4,746 | 5 |
| Total | 172,434 | 1,266 | 15,435 | 24,139 | 172,437 |

TABLE 2

| Extraction | | | | | | |
|---|---|---|---|---|---|---|
| Stream | 310 (oxidized sulfur containing diesel stream) Kg/h | 313 (MeOH) Kg/h | 314 (MeOH and oxidized sulfur compounds) Kg/h | 318 (diesel) Kg/h | 317 (MeOH) Kg/h | 320 (oxidized sulfur compounds) Kg/h |
| Water | 0 | 0 | 0 | 0 | 0 | 0 |
| Methanol | 0 | 266,931 | 266,724 | 207 | 266,724 | 0 |
| Diesel | 171,915 | 0 | 0 | 171,915 | 0 | 0 |
| Organic Sulfur | 517 | 0 | 512 | 5 | 0 | 507 |
| Acetic Acid | 0 | 0 | 0 | 0 | 0 | 0 |
| $Na_2WO_4$ (kg) | 5 | 0 | 5 | 0 | 0 | 0 |
| Total | 172,437 | 266,931 | 267,236 | 172,127 | 266,724 | 507 |

TABLE 3

| Solvent Deasphalting | | | | | |
|---|---|---|---|---|---|
| Stream | 320 (oxidized sulfur compounds) Kg/h | 322 (pentane) Kg/h | 324 (vacuum residue) Kg/h | 332 (deasphalted oil and pentane) Kg/h | 334 (asphaltenes and oxidized sulfur compounds) Kg/h |
| Stream Type | Feed | Solvent | Feed | Oil | Oil |
| Phase | Oil | Solvent | Oil | Oil | Oil |
| Vacuum residue | 0 | 0 | 10,000 | 0 | 0 |
| Oxidized sulfur compounds | 507 | 0 | 0 | 5 | 501 |
| Deasphalted oil | 0 | 0 | 0 | 7,105 | 0 |
| Asphaltenes | 0 | 0 | 0 | 0 | 2,895 |
| Pentane | 0 | 200 | 200 | 200 | 0 |
| Total | 507 | 200 | 10,200 | 7,310 | 3,396 |

While the Example corresponding to FIG. 3 is directed to the desulfurization of diesel fuel, it is understood that the process described can be operated with alternate hydrocarbon fluids or combinations of fluids.

For example, according to another embodiment, in the solvent deasphalting step, residue stream 320 was combined with butane stream 322 and atmospheric residue stream 324 and supplied to solvent deasphalting unit 330 to produce deasphalted oil stream 332, which includes DAO derived primarily from atmospheric residue stream 324, and asphaltene stream 334, which includes oxidized sulfur-containing compounds. Solvent deasphalting unit 330 was operated at a temperature of about 160° C. and a pressure of about 24 bars. The solvent to feed ratio was about 5:1 by volume. The solvent comprised butanes, consisting of about 96.8% by volume n/i-C4, about 2.7% by volume i-C5, and about 0.5% by volume n-C5. The DAO after separation of solvent is sent to oxidation vessel 304 to remove sulfur by oxidation and follow-up separation and oxidized products.

According to at least one embodiment, a distillation vessel 350 is added to separate desulfurized diesel stream 352, a high purity hydrocarbon product, and desulfurized DAO stream 354.

Table 4 provides the compositions of various streams for the Example illustrated in FIG. 3, in which the butane is used in stream 322.

TABLE 4

| Solvent Deasphalting | | | | | | | |
|---|---|---|---|---|---|---|---|
| Stream | 320 (sulfones) Kg/h | 322 (butane) Kg/h | 324 (atmos. residue) Kg/h | 332 (DAO) Kg/h | 334 (asphalt) Kg/h | 352 (diesel) Kg/h | 354 (DDAO) Kg/h |
| Butane | | 40,000 | | | | 168,477 | |
| AR | | | 10,000 | | | | |
| DAO | | | | 6,793 | | | 5,991 |
| Asphalt | | | | | 3,207 | | |
| Sulfones | 1,186 | | | | 507 | | |
| Total | 1,186 | 40,000 | 10,000 | 6,793 | 3,714 | 168,477 | 5,991 |

Although the various embodiments have been described in detail, it should be understood that various changes, substitutions, and alterations can be made hereupon without departing from the principle and scope. Accordingly, the scope should be determined by the following claims and their appropriate legal equivalents.

The singular forms "a," "an," and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed as from about one particular value to about another particular value. When such a range is expressed, it is to be understood that another embodiment is from the one particular value or to the other particular value, along with all combinations within said range.

Throughout this application, where patents or publications are referenced, the disclosures of these references in their entireties are intended to be incorporated by reference into this application, in order to more fully describe the state of the art to which the embodiments pertain, except when these reference contradict the statements made herein.

That which is claimed is:

1. A method of upgrading a hydrocarbon feedstock, the method comprising:

supplying the hydrocarbon feedstock to an oxidation reactor, the hydrocarbon feedstock comprising sulfur-containing compounds and nitrogen-containing compounds;

contacting the hydrocarbon feedstock with an oxidant in the presence of a catalyst in the oxidation reactor under conditions sufficient to selectively oxidize sulfur-containing compounds present in the hydrocarbon feedstock to produce an oxidized hydrocarbon stream that comprises hydrocarbons, oxidized sulfur-containing compounds, and oxidized nitrogen-containing compounds;

separating the hydrocarbons and the oxidized sulfur- and nitrogen-containing compounds in the oxidized hydrocarbon stream by solvent extraction with a non-acidic polar organic solvent, the non-acidic polar organic solvent being dimethylformamide, to produce an extracted hydrocarbon stream and a mixed stream, the mixed stream comprising the non-acidic polar organic solvent, the oxidized sulfur-containing compounds, and the oxidized nitrogen-containing compounds, wherein the extracted hydrocarbon stream has a lower concentration of sulfur and nitrogen than the hydrocarbon feedstock;

separating the mixed stream using a distillation column into a first recovered non-acidic polar organic solvent stream and a first residue stream;

supplying the first residue stream to a deasphalting unit to produce a deasphalted oil stream and a pitch stream, wherein the pitch stream includes a substantial portion of the oxidized sulfur-containing compounds and the nitrogen-containing compounds removed from the hydrocarbon feedstock;

supplying the extracted hydrocarbon stream to an adsorption column, the adsorption column being charged with an adsorbent suitable for the removal of oxidized compounds present in the extracted hydrocarbon stream, the adsorption column producing a high purity hydrocarbon product stream and a second residue stream, the second residue stream containing a portion of the oxidized sulfur-containing compounds and the oxidized nitrogen-containing compounds, and a spent adsorbent stream, the spent adsorbent stream containing another portion of the oxidized sulfur-containing compounds and the oxidized nitrogen-containing compounds; and supplying the spent adsorbent stream to the deasphalting unit to remove contaminants from the deasphalted oil in the deasphalting unit;

supplying the extracted hydrocarbon stream to a stripper to produce a second recovered non-acidic polar organic solvent stream and a stripped hydrocarbon stream; and recycling the first recovered non-acidic polar organic solvent stream and the second non-acidic polar organic solvent stream to an extraction vessel for the step of separating the hydrocarbons and the oxidized sulfur compounds in the oxidized hydrocarbon stream.

2. The method of claim 1, further comprising:

recycling a portion of the high purity hydrocarbon product stream to the oxidation reactor.

3. The method of claim 1, wherein the oxidant is selected from the group consisting of air, oxygen, oxides of nitrogen, peroxides, hydroperoxidies, organic peracids, and combinations thereof.

4. The method of claim 1, wherein the catalyst is a metal oxide having the formula $M_xO_y$, wherein M is an element selected from Groups IVB, VB, and VIB of the periodic table.

5. The method of claim 1, wherein the oxidation reactor is maintained at a temperature of between about 20° C. and about 150° C. and at a pressure of between about 1 bar and about 10 bars.

6. The method of claim 1, wherein the ratio of the oxidant to sulfur containing compounds present in the hydrocarbon feedstock is between about 4:1 and 10:1.

7. The method of claim 1, wherein the non-acidic polar organic solvent has a Hildebrandt value of greater than about 19.

8. The method of claim 1, wherein the solvent extraction is conducted at a temperature of between about 20° C. and about 60° C. and at a pressure of between about 1 bar and about 10 bars.

9. The method of claim 1, further comprising:

supplying the second residue stream to the deasphalting unit.

10. The method of claim 1, wherein the adsorbent is selected from the group consisting of activated carbon, silica gel, alumina, natural clays, zeolites; fresh, used, regenerated, or rejuvenated catalysts, and combinations of the same.

11. The method of claim 1, wherein the adsorbent is a polymer coated support, wherein the support is selected from the group consisting of silica gel, alumina, and activated carbon, and the polymer is selected from the group consisting of polysulfone, polyacrylonitrile, polystyrene, polyester terephthalate, polyurethane and combinations of the same.

12. The method of claim 1, wherein the supplying the first residue stream to the deasphalting unit further comprises supplying a deasphalting solvent selected from a paraffinic solvent having between 3 and 7 carbon atoms to the deasphalting unit and extracting the first residue stream with the deasphalting solvent at a temperature and pressure at or below the critical temperature and pressure of the paraffinic solvent, wherein the deasphalted oil stream includes a major fraction of the paraffinic solvent.

13. A method of upgrading a hydrocarbon feedstock, the method comprising:

supplying the hydrocarbon feedstock to an oxidation reactor, the hydrocarbon feedstock comprising sulfur-containing compounds;

catalytically oxidizing the sulfur-containing compounds in the hydrocarbon feedstock in the oxidation reactor with an oxidant in the presence of a catalyst under conditions sufficient to selectively oxidize the sulfur-containing compounds present in the hydrocarbon feedstock to sulfones and produce a treated hydrocarbon stream comprising hydrocarbons and sulfones and a waste catalyst stream;

extracting the treated hydrocarbon stream with a non-acidic polar organic solvent, the non-acidic polar organic solvent being dimethylformamide, in an extraction vessel to produce an extracted hydrocarbon stream and a mixed stream, the mixed stream comprising the non-acidic polar organic solvent and the sulfones, wherein the extracted hydrocarbon stream has a lower sulfur concentration than the hydrocarbon feedstock;

separating the mixed stream using a solvent regeneration column into a recovered non-acidic polar organic solvent stream and a residue stream comprising sulfones;

supplying the residue stream comprising sulfones to a deasphalting unit and extracting the residue stream with a paraffinic solvent having between 3 and 7 carbon atoms to produce a deasphalted oil stream and a pitch stream, wherein the extraction of the residue stream is conducted a temperature and pressure that is at or below the supercritical temperature and pressure of the paraffinic solvent;

supplying the extracted hydrocarbon stream to a distillation column and separating the extracted hydrocarbon stream into a high purity hydrocarbon product stream and a desulfurized deasphalted oil stream; and recycling at least a portion of the recovered non-acidic polar organic solvent stream to the extraction vessel, wherein at least a portion of the recovered non-acidic polar organic solvent stream is combined with the non-acidic polar organic solvent.

14. The method of claim 13, further comprising:

recycling the deasphalted oil stream to the oxidation reactor.

15. The method of claim 13, wherein the hydrocarbon feedstock further comprises nitrogen-containing compounds, such that the step of catalytically oxidizing further comprises catalytically oxidizing the nitrogen-containing compounds in the hydrocarbon feedstock with the oxidant in the presence of the catalyst, and wherein the residue stream supplied to the deasphalting unit includes the oxidized nitrogen-containing compounds.

16. The method of claim 13, wherein the oxidation reactor is maintained at a temperature of between about 20° C. and about 150° C. and at a pressure of between about 1 bar and about 10 bars and the solvent extraction is conducted at a temperature of between about 20° C. and about 60° C. and at a pressure of between about 1 bar and about 10 bars.

17. The method of claim 13, wherein the non-acidic polar organic solvent has a Hildebrandt value of greater than about 19.

* * * * *